US009247859B2

(12) United States Patent
Bigott

(10) Patent No.: US 9,247,859 B2
(45) Date of Patent: Feb. 2, 2016

(54) RACK SYSTEMS FOR USE WITH KITCHENWARE WASHING ASSEMBLIES AND RELATED METHODS

(75) Inventor: James W. Bigott, Fenton, MO (US)

(73) Assignee: DUKE MANUFACTURING CO., St. Louis, MO (US)

( * ) Notice: Subject to any disclaimer, the term of this patent is extended or adjusted under 35 U.S.C. 154(b) by 1051 days.

(21) Appl. No.: 11/869,458

(22) Filed: Oct. 9, 2007

(65) Prior Publication Data

US 2009/0090680 A1 Apr. 9, 2009

(51) Int. Cl.
*A47L 15/50* (2006.01)
*A47L 15/00* (2006.01)

(52) U.S. Cl.
CPC ..... *A47L 15/505* (2013.01); *A47L 15/00* (2013.01); *Y10T 29/53* (2015.01)

(58) Field of Classification Search
CPC ..... A47J 37/0694; A47J 47/16
USPC ..... 134/56 D
See application file for complete search history.

(56) References Cited

U.S. PATENT DOCUMENTS

| | | | | |
|---|---|---|---|---|
| 3,072,452 | A * | 1/1963 | Sleeper | 312/228 |
| 3,556,625 | A * | 1/1971 | Kauffman | 312/301 |
| 4,834,125 | A * | 5/1989 | Insalaco | 134/201 |
| 6,109,455 | A * | 8/2000 | Schroeder | 211/41.9 |
| 6,364,130 | B2 * | 4/2002 | Wright | 211/41.3 |
| 6,659,114 | B2 * | 12/2003 | Bigott | 134/95.3 |
| 6,786,339 | B2 * | 9/2004 | Deiss et al. | 211/41.8 |
| 7,021,321 | B2 | 4/2006 | Bigott | |
| 7,475,698 | B2 | 1/2009 | Bigott | |
| 7,527,062 | B2 | 5/2009 | Bigott | |
| 7,578,305 | B2 | 8/2009 | Bigott | |
| 7,763,119 | B2 | 7/2010 | Bigott | |
| 2006/0108298 | A1 * | 5/2006 | Kim | 211/41.8 |
| 2006/0218872 | A1 | 10/2006 | Bigott | |
| 2006/0254619 | A1 | 11/2006 | Bigott | |
| 2010/0139701 | A1 | 6/2010 | Bigott | |
| 2010/0282281 | A1 | 11/2010 | Bigott | |

FOREIGN PATENT DOCUMENTS

| | | | |
|---|---|---|---|
| EP | 1281347 | * | 2/2003 |
| WO | WO2006/115929 | | 3/2007 |
| WO | WO2007065786 | * | 6/2007 |
| WO | WO2010/045362 | | 4/2010 |

OTHER PUBLICATIONS

Machine translation of WO 2007/065786 (Jun. 14, 2007).*

* cited by examiner

*Primary Examiner* — David Cormier
(74) *Attorney, Agent, or Firm* — Harness, Dickey & Pierce, P.L.C.

(57) ABSTRACT

A rack system is provided that is suitable, for example, for installation to a kitchenware washing assembly. The kitchenware washing assembly may include a tank for holding fluid for washing kitchenware, and walls defining the tank and being arranged to hold the fluid in the tank. The rack system generally includes a mounting fixture connectable to the tank of the kitchenware washing assembly, and a rack connectable to the mounting fixture for holding the kitchenware in the tank. The rack is adjustable relative to the mounting fixture between a first position in which the rack is connected to the mounting fixture, and a second position in which the rack is connected to the mounting fixture.

7 Claims, 10 Drawing Sheets

RACK SYSTEMS FOR USE WITH KITCHENWARE WASHING ASSEMBLIES AND RELATED METHODS

FIELD

The present disclosure generally relates to rack systems for kitchenware washing assemblies and methods related thereto, and more particularly to adjustable rack systems that can hold kitchenware within the kitchenware washing assemblies and methods for installing the rack systems to kitchenware washing assemblies.

BACKGROUND

The statements in this section merely provide background information related to the present disclosure and may not constitute prior art.

Commercial washers have been in the marketplace for decades. Many of the commercial washers that are currently on the market include multiple tanks for various cleaning stages (e.g., a scraping tank, a washing tank, a rinsing tank, a sanitizing tank, etc.). The washing tank, at a basic level, typically includes features such as a rectangular tank for receiving kitchenware to be washed therein, a drain in the tank, a valve for closing the drain, outlets attached to walls of the tank for directing water down into the tank, and a pump to circulate water from within the tank into a manifold that feeds the water through the outlets.

SUMMARY

Exemplary embodiments of the present disclosure are generally directed toward kitchenware washing assemblies. In one exemplary embodiment, a kitchenware washing assembly generally includes a tank for holding fluid for washing kitchenware, and a rack connectable to the tank for holding the kitchenware in the tank. The rack is adjustable within the tank between at least a first position and a second position.

Other exemplary embodiments of the present disclosure are generally directed toward rack systems suitable, for example, for installation to kitchenware washing assemblies, which generally include tanks for holding fluid for washing kitchenware, and walls defining the tanks and being arranged to hold the fluid in the tanks. In one exemplary embodiment, a rack system generally includes a mounting fixture connectable to the tank of the kitchenware washing assembly, and a rack connectable to the mounting fixture for holding the kitchenware in the tank. The rack is adjustable relative to the mounting fixture between a first position in which the rack is connected to the mounting fixture, and a second position in which the rack is connected to the mounting fixture.

In another exemplary embodiment, a rack system generally includes three or more racks for holding kitchenware between the racks in a tank. At least one of the three or more racks is connectable to the tank. The three or more racks each include spaced apart supports for holding the kitchenware between the supports in each of the three or more racks, and a stop extending between at least two of the supports for help in retaining the kitchenware between the supports in each of the three or more racks. The at least one of the three or more racks that is connectable to the tank is also adjustable within the tank between a first position and a second position.

In still another exemplary embodiment, a rack system generally includes means for holding kitchenware in the tank, and means for adjusting the kitchenware holding means within the tank. At least part of the adjusting means is connectable to the tank.

Still other exemplary embodiments of the present disclosure are generally related to exemplary methods for installing rack systems to kitchenware washing assemblies to hold kitchenware in tanks of the kitchenware washing assemblies. In one exemplary embodiment, a method includes connecting a mounting fixture to a tank of a kitchenware washing assembly, and connecting a rack to the mounting fixture such that the rack is adjustable relative to the mounting fixture between a first position and a second position.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
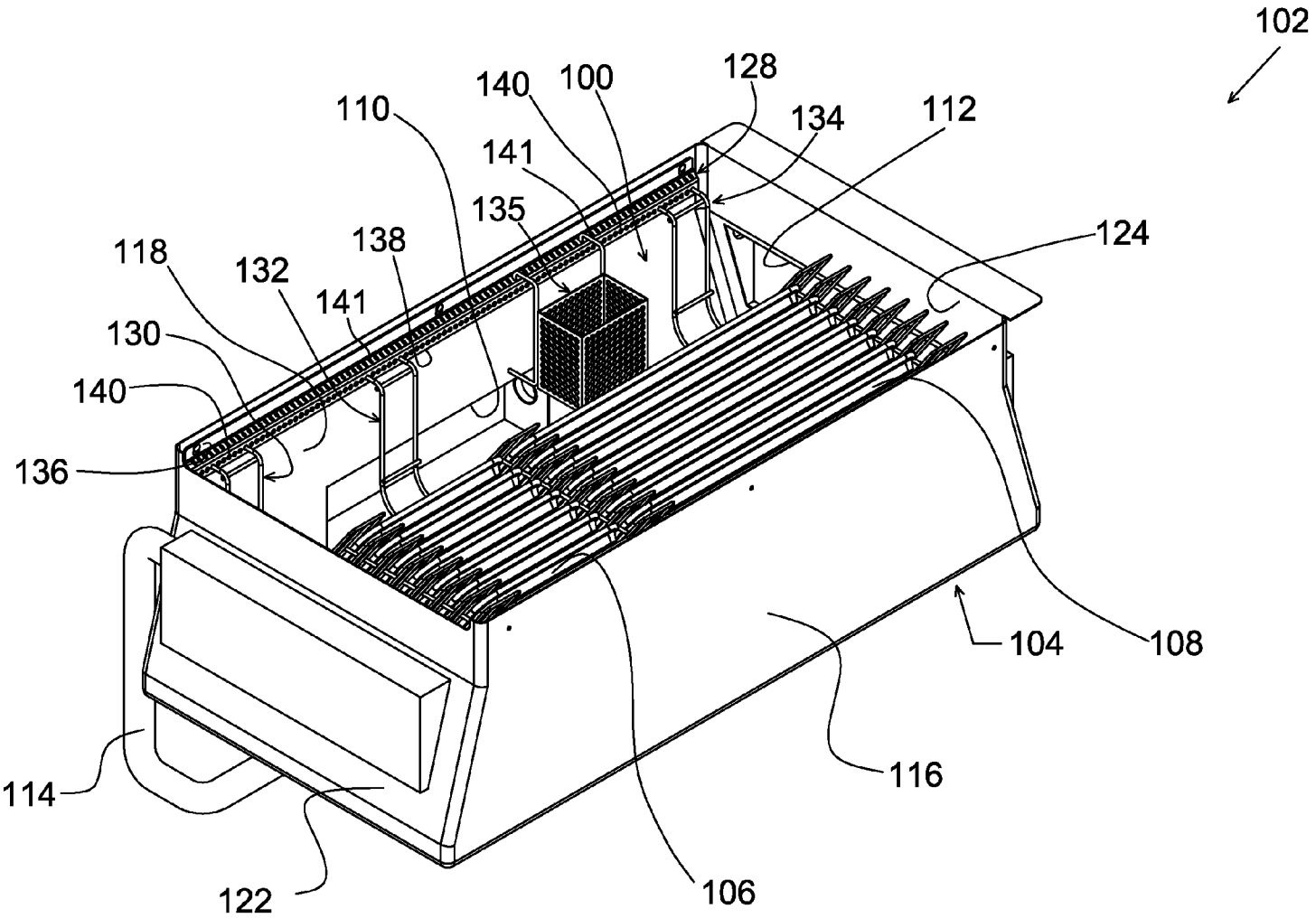
FIG. 1 is a front perspective view of an exemplary embodiment of a rack system shown installed to a kitchenware washing assembly, and shown holding sheet pans in a tank of the kitchenware washing assembly.

The following description is merely exemplary in nature and is not intended to limit the present disclosure, application, or uses. It should be understood that throughout the drawings, corresponding reference numerals indicate like or corresponding parts and features.

Referring now to the drawings, FIGS. 1-10 illustrate an exemplary embodiment of a rack system 100 suitable for installation to a kitchenware washing assembly 102. The rack system 100 may be used to hold kitchenware within a tank 104 of the washing assembly 102 during washing operation. As will be described in more detail hereinafter, the rack system 100 may be adjusted within the tank 104 of the washing assembly 102, for example, to accommodate different sizes, types, etc. of kitchenware. In the illustrated embodiment, the kitchenware includes sheet pans 106 and 108. While the illustrated sheet pans 106 and 108 are differently sized, sheet pans 106 and 108 can be similarly sized within the scope of the present disclosure. In addition, in other exemplary embodiments, rack systems can accommodate sheet pans having more than two different sizes. It is to be understood that the present disclosure should not be limited to rack systems used to hold/accommodate sheet pans. For example, rack systems can accommodate kitchenware including trays, dishes, sheet ware for displaying, for example, large volumes of food, pots, silverware, dishware, food service ware and equipment, food trays, grease filters, gratings, other kitchen items that may require cleaning, etc. within the scope of the present disclosure.

Figure 2:
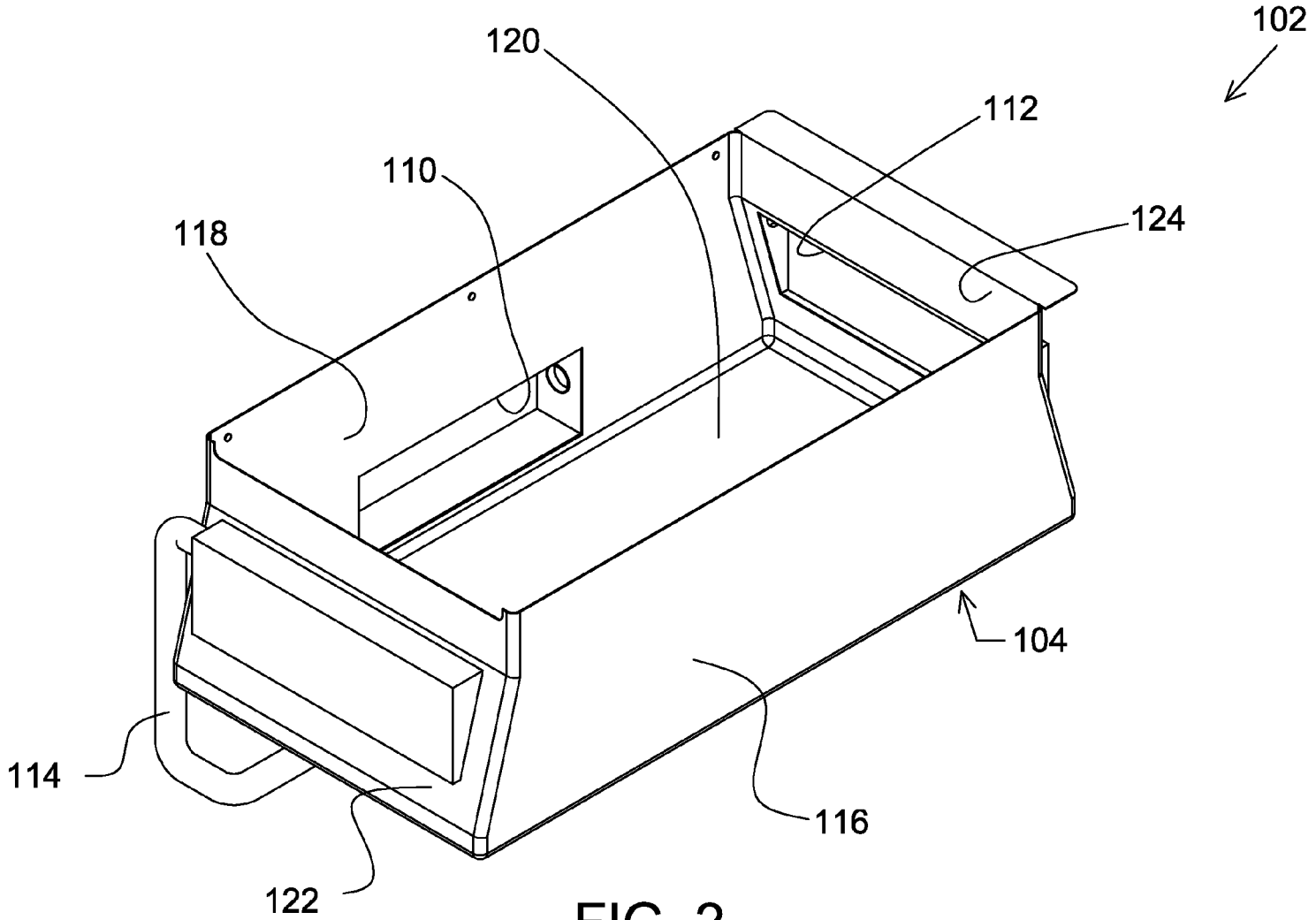
FIG. 2 is a front perspective view of the kitchenware washing assembly of FIG. 1 with the rack system, sheet pans, and a hanging basket removed.

As shown in FIGS. 1 and 2, the washing assembly 102 generally includes the tank 104 for holding fluid (e.g., water, cleaning fluid, etc.) for washing the kitchenware, an inlet 110 for removing fluid from the tank 104, and outlets 112 (only one is visible) for discharging fluid into the tank 104. Intake plates may be positioned over the inlet 110 within the scope of the present disclosure. Discharge plates may be positioned over one or more of the outlets 112 within the scope of the present disclosure. One or more pumps (not shown) may be located, for example, under the tank 104 for circulating the fluid in the tank 104 from the inlet 110 to the outlets 112 for use in washing the kitchenware. Fluid conduits 114 may couple the one or more pumps, in fluid communication, between the inlet 110 and the outlets 112. The washing assembly 102 may include a number of inlets and outlets other than disclosed herein within the scope of the present disclosure. And washing assemblies configured (e.g., sized, shaped, constructed, etc.) differently than disclosed herein may be used.

The illustrated washing assembly tank 104 is generally rectangular in shape and generally includes a forward wall 116, an opposing rearward wall 118, a bottom wall 120 (FIG. 2), and two side walls 122 and 124. The walls 116, 118, 120, 122, and 124 are arranged to hold the fluid in the tank 104 for washing operation. Because it is desirable to have the fluid discharge into the tank 104 from the outlets 112 in a generally downwardly angled direction (e.g., to help avoid splashing fluid out of the tank 104, etc.), the side walls 122 and 124 can include portions that are angled generally downwardly. The outlets 112 can be located on these generally downwardly angled portions of the side walls 122 and 124 such that the fluid discharging into the tank 104 from the outlets 112 is directed in the generally downwardly angled direction. Alternative embodiments, however, can include tanks formed with more or less than four walls (e.g., more or less than a forward wall, a rearward wall, and two side walls, etc.) and/or tanks formed in any other suitable configuration including, for example, cup-shaped, cylindrical, cubical, triangular, trapezoidal, circular, ovular, prismatic, a configuration having four walls generally perpendicular to the bottom, etc.

With reference now to FIGS. 3-6, the illustrated rack system 100 generally includes first and second mounting fixtures 126 and 128 connectable to the tank 104 of the washing assembly 102, and three racks 130, 132, and 134 connectable to the mounting fixtures 126 and 128. A hanging basket 135 (FIGS. 1 and 3) is also connectable to the second mounting fixture 128. In the illustrated embodiment, the racks 130, 132, and 134 may be understood to be connectable to the washing assembly tank 104 via the mounting fixtures 126 and 128. And the hanging basket 135 may be understood to be connectable to the washing assembly tank 104 via the second mounting fixture 128.

The mounting fixtures 126 and 128 each include a base plate 136 and a flange 138. And the flange 138 extends generally away from the base plate 136 in a generally forwardly direction. The flange 138 of each mounting fixture 126 and 128 can be integrally, monolithically, etc. formed as one piece of material with the base plate 136. Openings 140 are formed in the flange 138 of each mounting fixture 126 and 128, and the racks 130, 132, and 134 can connect to the mounting fixtures 126 and 128 at the openings 140. The openings 140 allow the racks 130, 132, and 134 to be connected to, disconnected from, adjusted (e.g., moved, slid, etc.) relative to, reconnected to, etc. the mounting fixtures 126 and 128 as desired. Openings 141 are formed generally above the openings 140 in each mounting fixture 126 and 128, and generally between the base plate 136 and the flange 138 of each mounting fixture 126 and 128. The hanging basket 135 can connect to the second mounting fixture 128 at the openings 141 and hang at least partly within the washing assembly tank 104 for washing, for example, kitchenware (e.g., utensils, etc.). The openings 141 allow the hanging basket 135 to be connected to, disconnected from, adjusted (e.g., moved, slid, etc.) relative to, reconnected to, etc. the mounting fixture 128 as desired. The hanging basket 135 could be connected to the first mounting fixture 126 within the scope of the present disclosure.

In other exemplary embodiments, rack systems may include more than or less than two mounting fixtures and/or more than or less than three racks. In addition, exemplary embodiments may include more than or less than one hanging basket. For example, in one exemplary embodiment, a rack assembly may include four racks. In still other exemplary embodiments, rack systems may include mounting fixtures configured (e.g., sized, shaped, constructed) differently than disclosed herein but still capable of supporting and/or holding a rack and/or a hanging basket; and/or allowing connection of a rack and/or a hanging basket thereto; and/or allowing adjustment of a rack and/or a hanging basket relative thereto. In further exemplary embodiments, hanging fixtures other than hanging baskets may be connectable to washing assembly tanks, for example, for holding items within the tank for washing. In still other exemplary embodiments, hanging baskets may be configured (e.g., sized, shaped, constructed, etc.) differently than illustrated herein.

With additional reference to FIGS. 7-10, rack 130 of the rack system 100 will be described with it to be understood that a description of racks 132 and 134 is substantially the same. The rack 130 includes a frame 142 comprising multiple spaced apart support sections 144 (broadly, supports) configured (e.g., sized, shaped, constructed, etc.) to hold kitchenware (e.g., the sheet pans 106 and 108, etc.) in the rack 130 (e.g., FIGS. 3 and 4, etc.). Each support section 144 has a generally rectangular shape with rounded corners. A longitudinal support member 146 extends generally between upper and lower sides 148 and 150 of each support section 144 to help provide rigidity, strength, stability, etc. thereto. And connection members 152, 154, and 156 connect the multiple support sections 144 of the frame 142 together. Connection members 152 and 154 extend through each support section 144 and connect to the longitudinal support members 146 of each support section 144; and connection member 156 extends generally under each support section 144 and connects to the lower side 150 of each support section 144. Together, the connection members 152, 154, and 156 can help securely hold the support sections 144 in a generally aligned orientation and may provide rigidity, strength, stability, etc. to the frame 142 of the rack 130.

Figure 3:
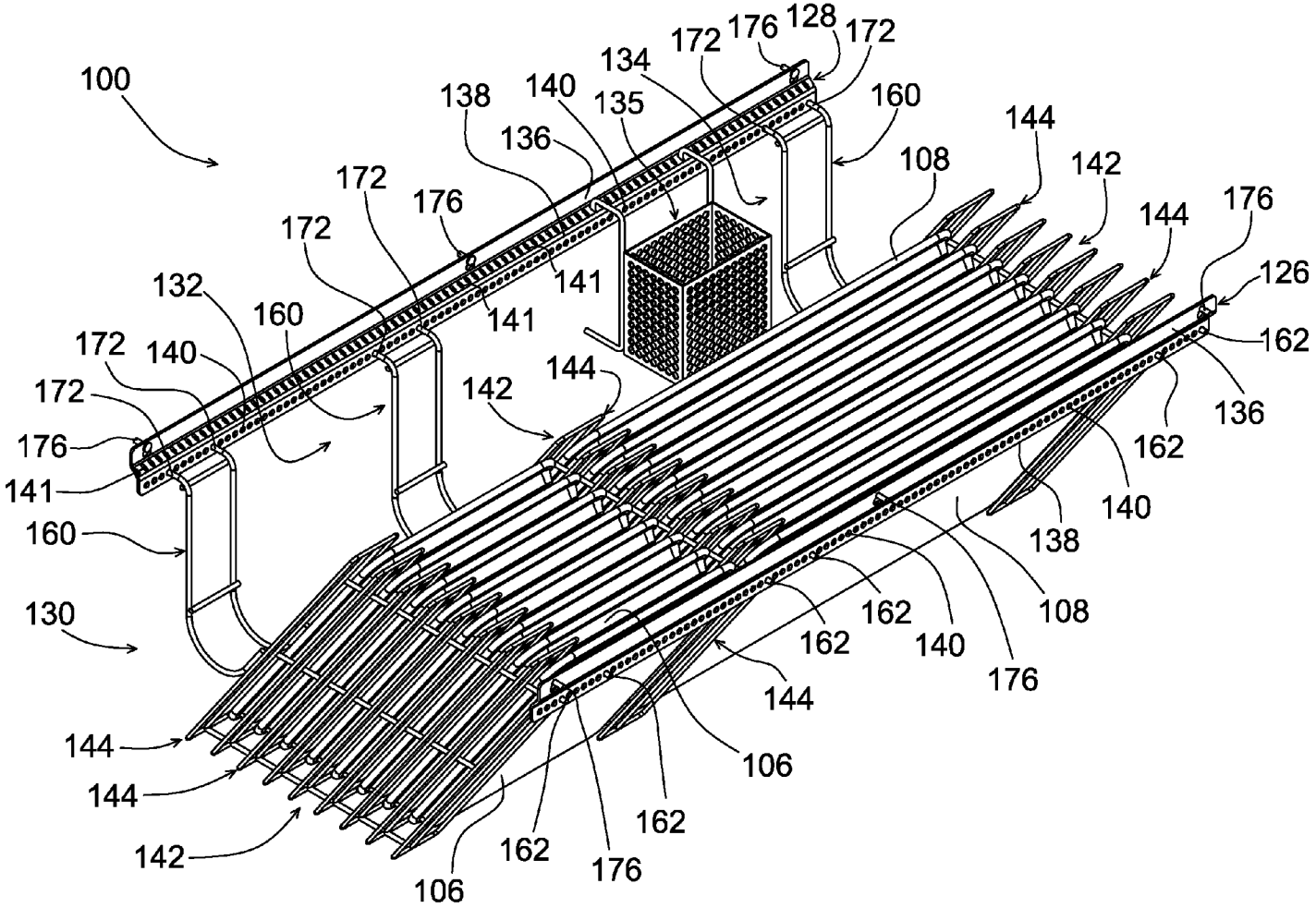
FIG. 3 is a front perspective view of the rack system and hanging basket of FIG. 1 removed from the tank of the kitchenware washing assembly and with the rack system shown holding the sheet pans.
Figure 4:
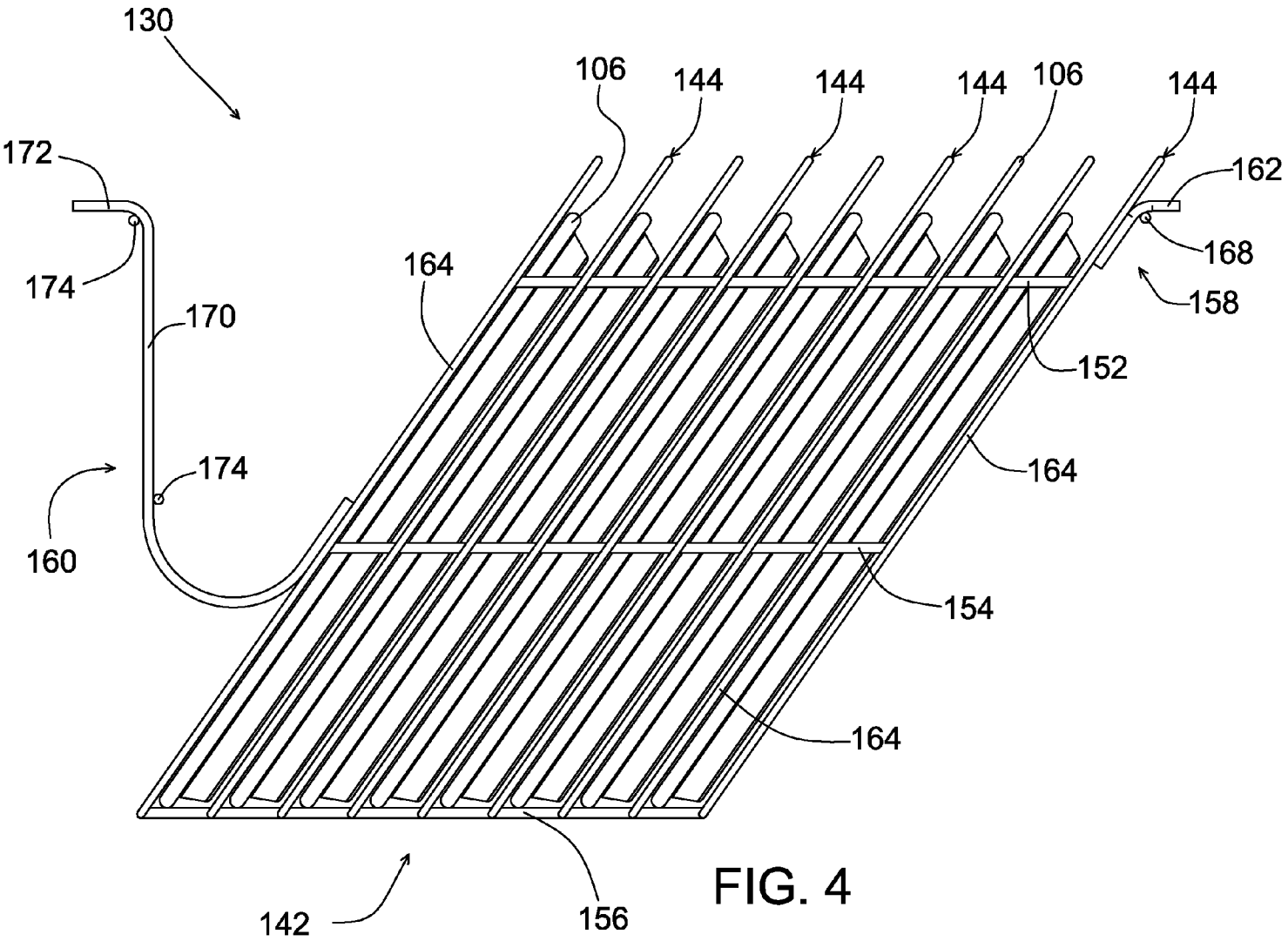
FIG. 4 is a side elevation view of the rack system and sheet pans of FIG. 3 with mounting fixtures of the rack system removed and the hanging basket removed.
Figure 5:
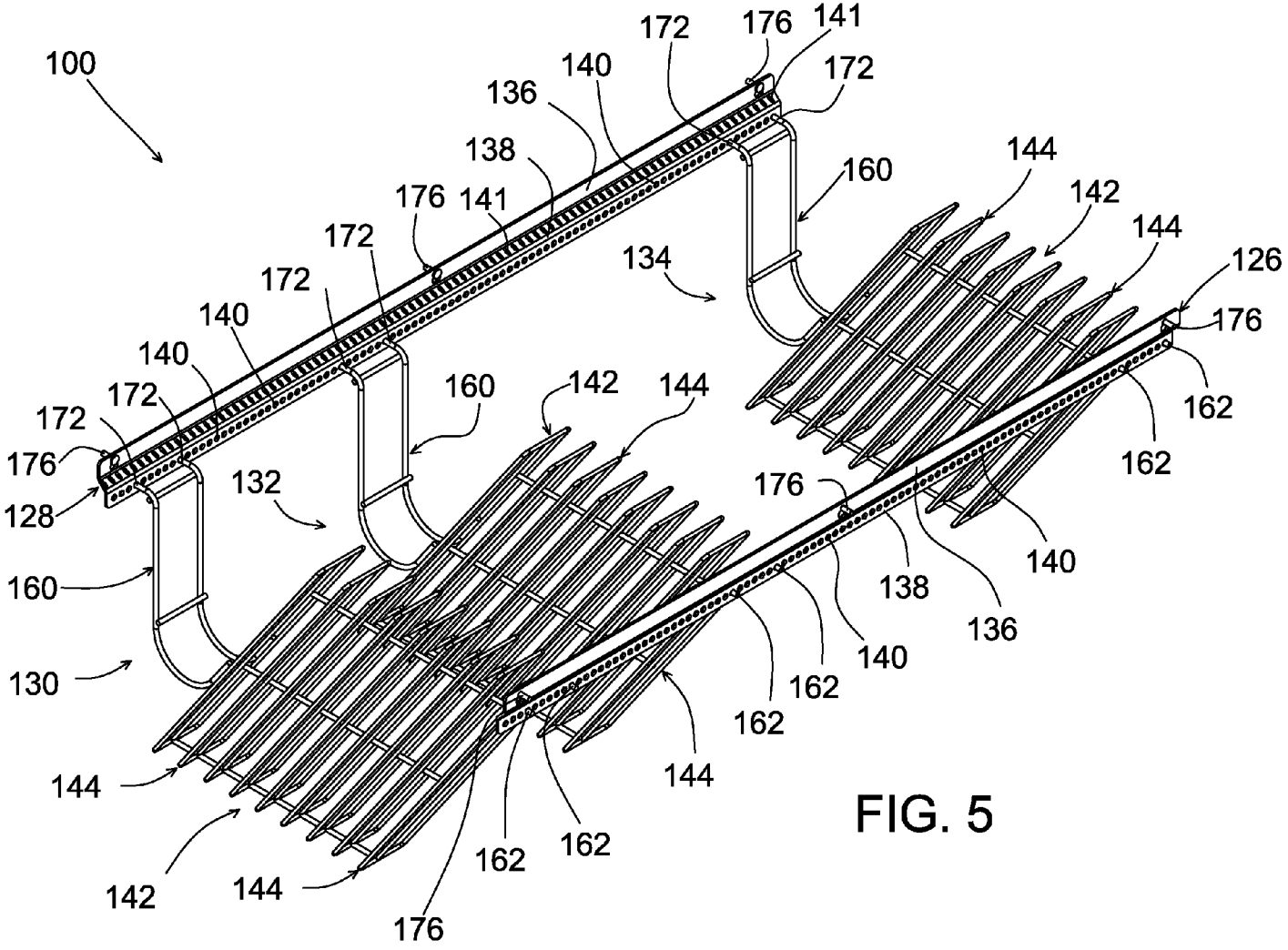
FIG. 5 is the front perspective view of the rack system of FIG. 3 with the sheet pans removed and the hanging basket removed.
Figure 6:
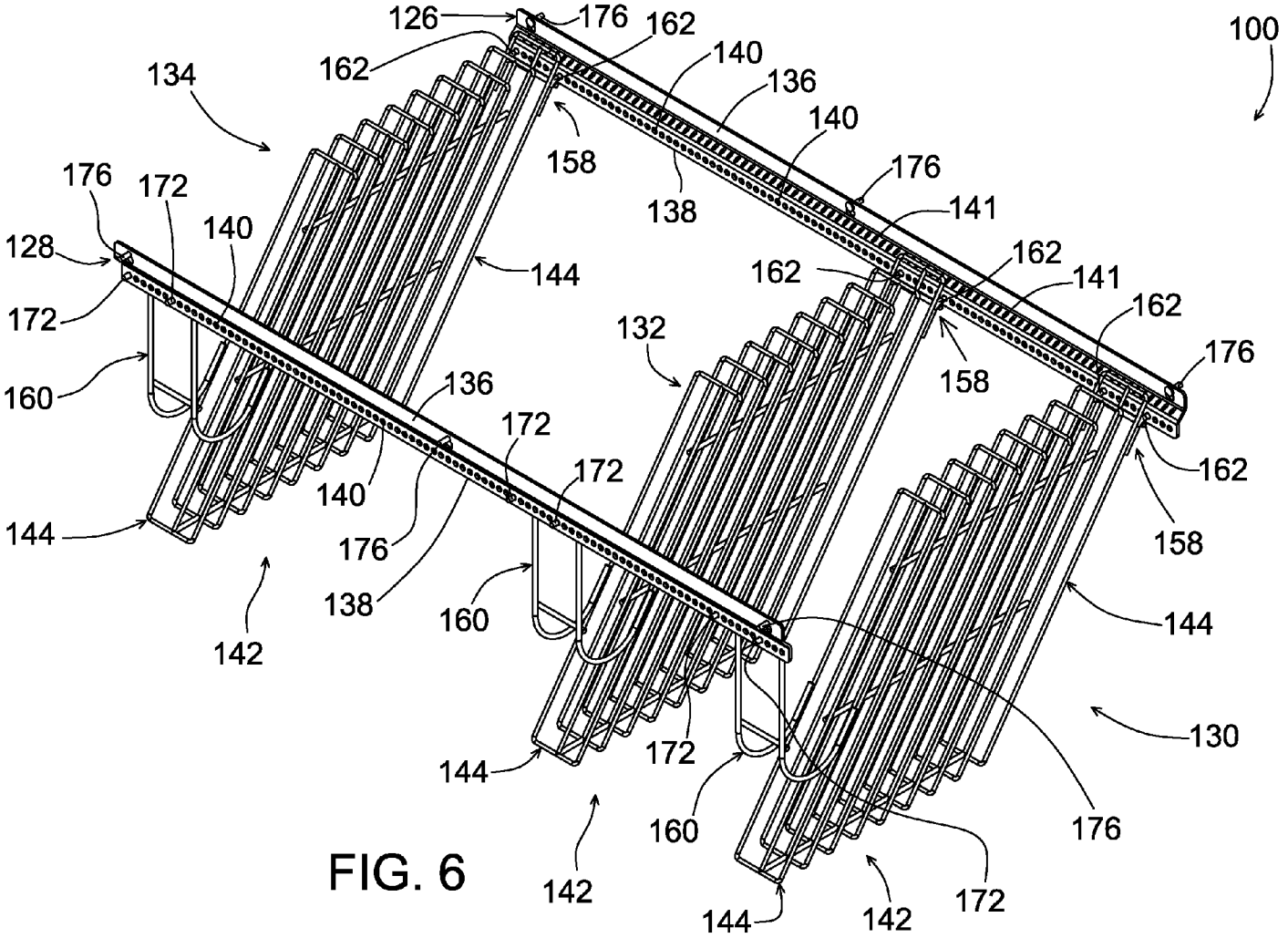
FIG. 6 is a rear perspective view of the rack system of FIG. 5.
Figure 7:
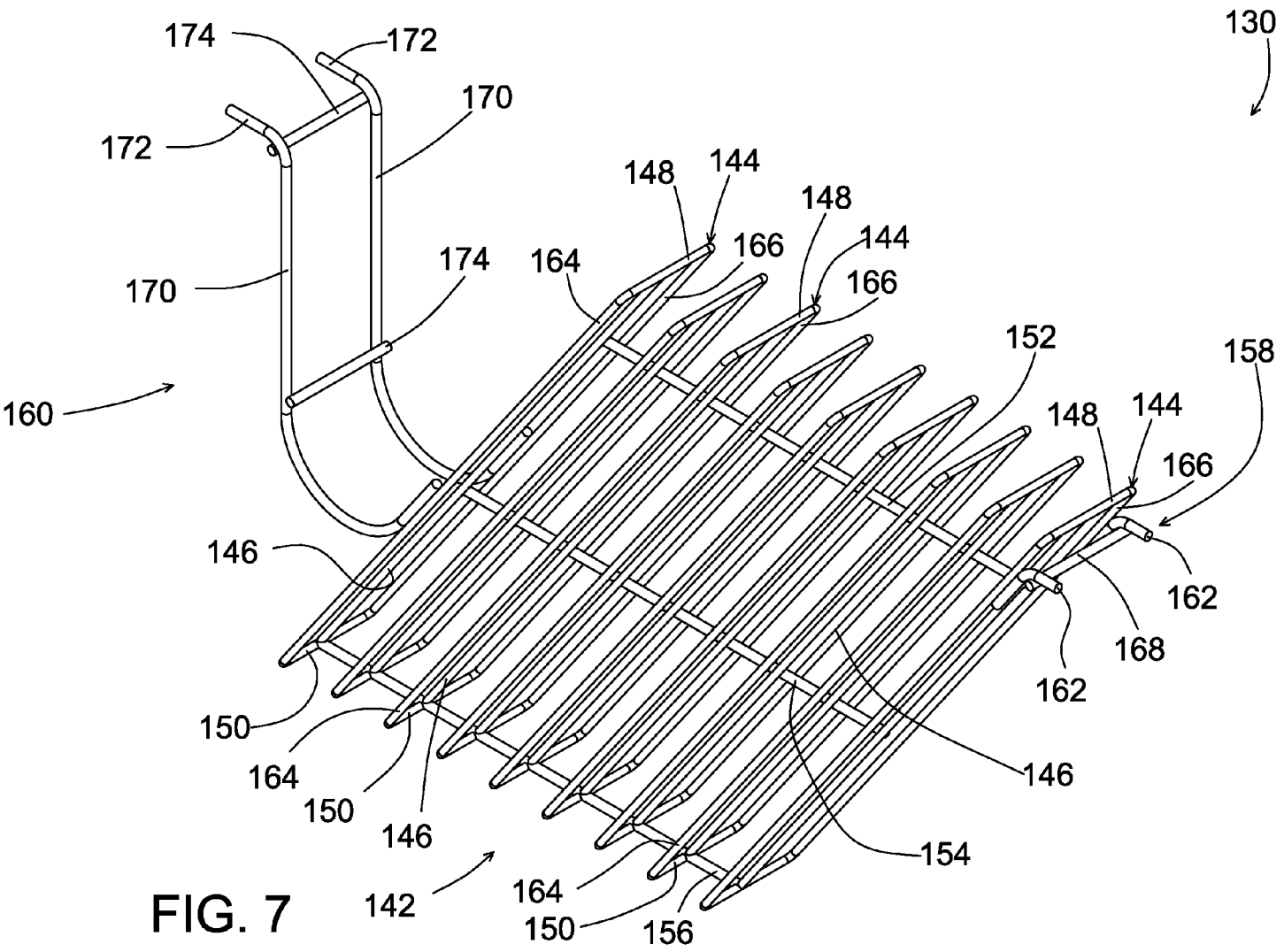
FIG. 7 is a front perspective view of a rack of the rack system of FIG. 5.

The illustrated rack 130 also includes a forward mount 158 and a rearward mount 160 that connect to a respective forward support section 144 and rearward support section 144 of the rack frame 142. The mounts 158 and 160 can be used to connect the rack 130 to the forward and rearward walls 116 and 118 of the washing assembly tank 104 (e.g., via the openings 140 in the mounting fixtures 126 and 128, etc.). The forward mount 158 includes a pair of pins 162 that connect (e.g., by a weld connection, a solder connection, an adhesive connection, a mechanical fastener connection, etc.) to longitudinal sides 164 and 166 of the forward support section 144, generally toward the upper side 148 of the support section 144. The two pins 162 are each configured (sized, shaped, constructed, etc.) to fit in one of the openings 140 of the mounting fixture 126 connected to the forward wall 116 of the washing assembly tank 104 (FIGS. 1 and 3). A transverse support member 168 extends between the pins 162 to help provide rigidity, strength, stability, etc. thereto. The rearward mount 160 includes a pair of generally U-shaped members 170 that connect (e.g., by a weld connection, a solder connection, an adhesive connection, a mechanical fastener connection, etc.) to longitudinal sides 164 and 166 of the rearward support section 144. The U-shaped members 170 also each include a pin 172 at a free end thereof, each configured (sized, shaped, constructed, etc.) to fit in one of the openings 140 of the mounting fixture 128 connected to the rearward wall 118 of the washing assembly tank 104 (FIGS. 1 and 3). Transverse support members 174 extend between the U-shaped members 170 to help provide rigidity, strength, stability, etc. thereto. The forward and/or rearward mounts 158 and/or 160 can each include more than or less than two pins within the scope of the present disclosure.

Figure 8:
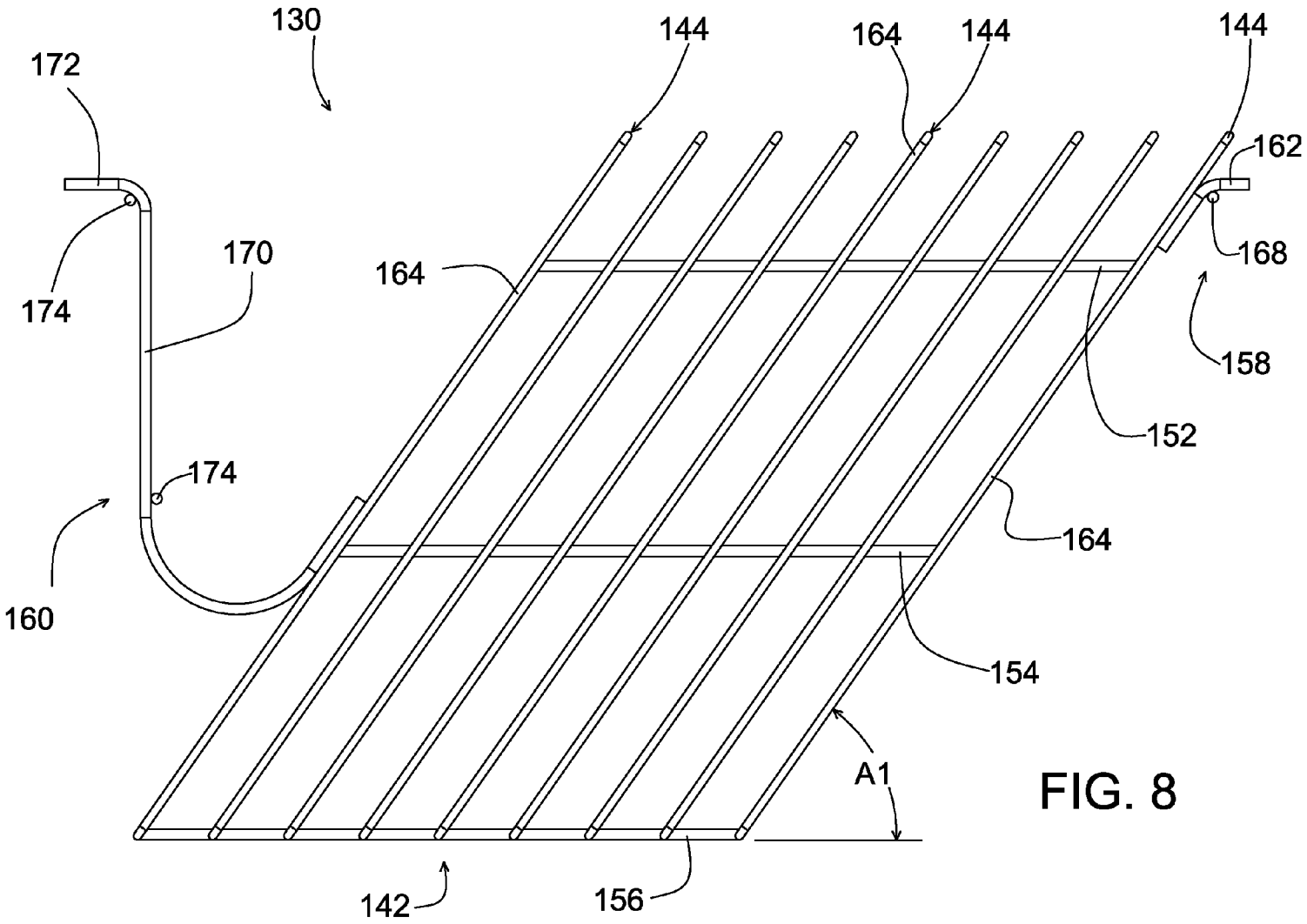
FIG. 8 is a side elevation view of the rack of FIG. 7.
Figure 9:
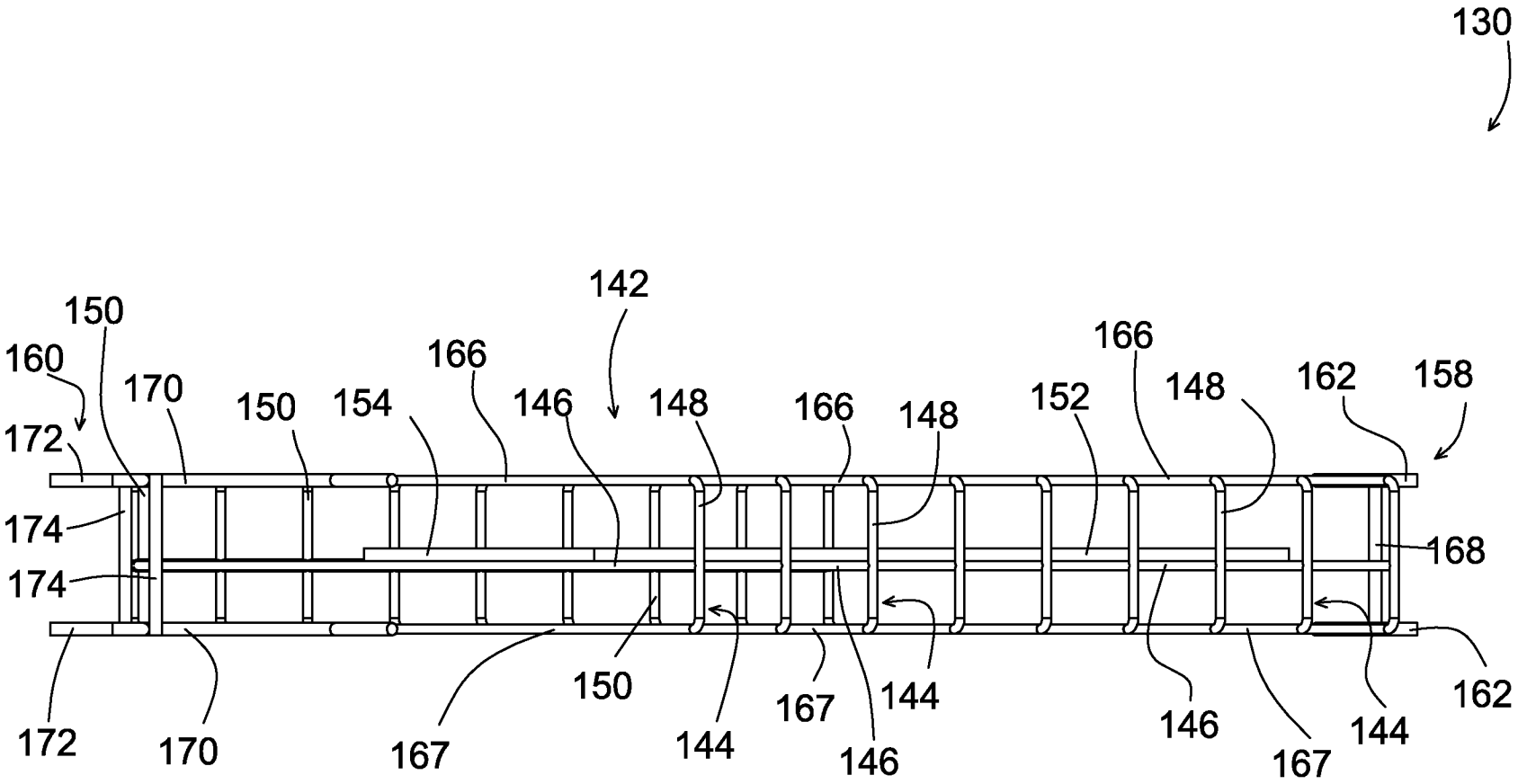
FIG. 9 is a top plan view of the rack of FIG. 7.
Figure 10:
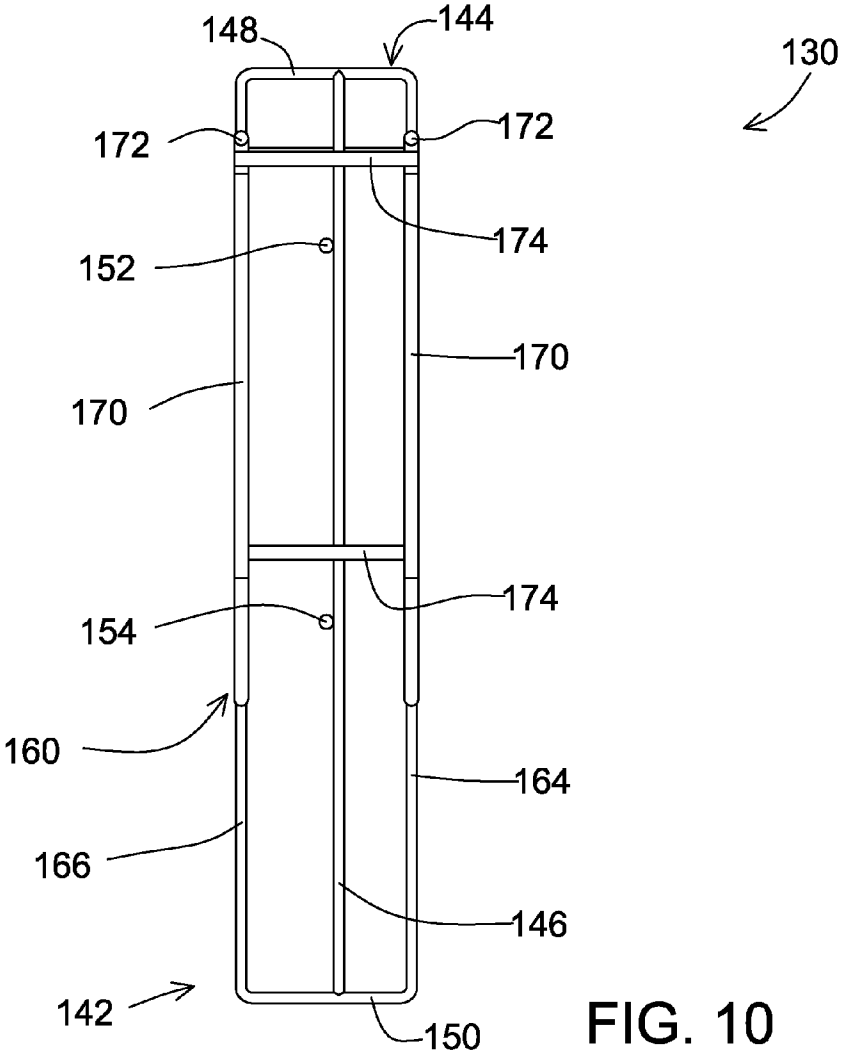
FIG. 10 is a rear elevation view of the rack of FIG. 7.

The illustrated rack 130 includes nine support sections 144 connected together to form the frame 142. The nine support sections 144 are each similarly oriented at an angle A1 of about fifty-five degrees (FIG. 8). This angled orientation can help, for example, the sheet pans 106 and 108 received by the rack system 100 fit generally completely within the tank 104 of the washing assembly 102 (and thus can help clean the entire sheet pans 106 and 108 without having to adjust them during cleaning operation). Each support section 144 is spaced laterally apart from an adjacent support section 144 by a distance of about 1.8 inches (about 4.5 centimeters) to define a gap between the support sections 144 for receiving the sheet pans 106 and 108 into the rack 130. This spacing allows the sheet pans 106 and 108 to fit between adjacent support sections 144, while also helping restrict the sheet pans 106 and 108 from undesired movement during washing operation (e.g., movement out of the rack 130, etc.). Also in the illustrated rack 130, the longitudinal sides 164 and 166 of each support section 144 may include a length dimension of about 17.9 inches (45.5 centimeters), and upper and lower sides 148 and 150 of each support section 144 may include a length dimension of about 3.0 inches (7.6 centimeters). Further, an overall length dimension of the rack 130 may be about 27.3 inches (69.3 centimeters), and an overall height dimension of the rack 130 may be about 14.3 inches (36.3 centimeters). In other exemplary embodiments, rack systems may include racks having more than or less than nine support sections. In still other exemplary embodiments, rack systems may include racks and/or rack support sections with dimensions, angular orientations, etc. different from those disclosed herein.

Components of the rack 130, including the frame 142, the forward mount 158, the rearward mount 160, etc., and/or components of the hanging basket 135 may be formed from metal rods (e.g., steel rods, aluminum rods, etc.) which can be bent, shaped, etc. to the desired form described and illustrated herein. In other exemplary embodiments, components of the rack 130 and/or components of the hanging basket 135 may be formed from materials, including, for example, plastics, nylons, polymers, metals, combinations thereof, etc., and may be formed by processes other than bending (e.g., mold processes, etc.). In addition, components (e.g., the frame 142, the forward mount 158, the rearward mount 160, etc.) of the rack 130 and/or components of the hanging basket 135 may be formed with members having other than circular cross-sections, for example, oval cross-sections, square cross-sections, rectangular cross-sections, other polygonal cross-sections, etc.

With reference again to FIGS. 1, 3, and 4, installation of the rack system 100 to the washing assembly 102 will be described. The mounting fixtures 126 and 128 can be connected to the forward and rearward walls 116 and 118 of the tank 104 by fasteners 176. For example, the fasteners 176 may extend through openings formed in each of the base plates 136 of the mounting fixtures 126 and 128 and through corresponding openings in the forward and rearward walls 116 and 118 of the tank 104. Alternatively, the mounting fixtures 126 and 128 may be connected to the walls 116 and 118 of the tank 104 by other mechanical fasteners, by adhesive, by solder, etc. within the scope of the present disclosure. And in other exemplary embodiments, mounting fixtures may be connected to other walls of tanks, for example left and right side walls of the tanks, bottom walls of the tanks, etc. In still other exemplary embodiments, mounting fixtures may be formed integrally, monolithically, etc. with walls of washing assembly tanks. Here, the tank walls may define mounting fixtures for connecting racks to the tanks.

The racks 130, 132, and 134 of the rack system 100 can be connected to the mounting fixtures 126 and 128 at any desired location within the washing assembly tank 104 to accommodate, as necessary, one or more sizes of the sheet pans 106 and 108 to be washed. The illustrated racks 130, 132, and 134 connect to the mounting fixtures 126 and 128 by positioning each of the pins 162 and 172 of the forward and rearward mounts 158 and 160 in the corresponding openings 140 in each of the flanges 138 of the mounting fixtures 126 and 128. These pin-and-opening connections can securely hold the racks 130, 132, and 134 at their desired location within the tank 104 (e.g., during placement of sheet pans 106 and 108 into the rack system 100, during washing operation of the sheet pans 106 and 108, during removing of the sheet pans 106 and 108 from the rack system 100, etc.). The openings 140 are spaced along each of the mounting fixture flanges 138 such that each of the forward and rearward mounting pins 162 and 172 of each rack 130, 132, and 134 can each be received into one of the openings 140. It should thus be appreciated that the racks 130, 132, and 134 can be connected to the mounting fixtures 126 and 128 at generally any desired location within the washing assembly tank 104 to accommodate, as necessary, different sizes of sheet pans to be washed. In the illustrated embodiment, the openings 140 in the mounting fixtures 126 and 128 are spaced apart along the flange 138 by a distance of about 0.5 inches (1.3 centimeters), and the two forward mounting pins 162 and the two rearward mounting pins 172 are each spaced apart by a distance of about 3.0 inches (7.6 centimeters). In other exemplary embodiments, rack systems may include racks with mounting pins and/or mounting fixtures with openings spaced differently than disclosed herein.

One or more of the racks 130, 132, and 134 connected to the mounting fixtures 126 and 128 can be adjusted within the washing assembly tank 104 from one location to another location as desired. For example, the pins 162 and 172 of the respective forward and rearward mounts 158 and 160 of one or more of the racks 130, 132, and 134 can be removed from the respective mounting fixture openings 140 in which they are received. The racks 130, 132, and/or 134 can then be adjusted as desired (e.g., moved from a first location to a second location relative to the mounting fixtures 126, 128, etc.). And the pins 162 and 172 of the respective forward and rearward mounts 158 and 160 of the racks 130, 132, and/or 134 can then be positioned in the proper mounting fixture openings 140 (e.g., at the second position, etc.). Adjusting one or more of the racks 130, 132, and 134 may be done, for example, to properly locate one or more of the racks 130, 132, and 134 to receive the sheet pans 106 and 108 to be washed, to accommodate different sized sheet pans from one washing cycle to another washing cycle, etc.

In the illustrated rack system 100, the racks 130, 132, and 134 may be resiliently flexible. The frame 142, the forward mount 158, and/or the rearward mount 160 of each rack 130, 132, and 134 may be flexed to provide room to move the mounting pins 162 and/or 172 into the respective mounting fixture openings 140 to connect the racks 130, 132, and 134 to the walls 116 and 118 of the tank 104 (e.g., via the openings 140 in the mounting fixtures 126 and 128, etc.). The resilient flexibility of the racks 130, 132, and 134 may also allow the frame 142, the forward mount 158, and/or the rearward mount 160 to be flexed to provide room to move the mounting pins 162 and/or 172 out of the respective mounting fixture openings 140 to disconnect the racks 130, 132, and 134 from the walls 116 and 118 of the tank 104 (e.g., from the openings 140 in the mounting fixtures 126 and 128, etc.).

The sheet pans 106 and 108 to be washed may be placed in the installed rack system 100 by sliding each sheet pan 106 and 108 between support sections 144 of two adjacent racks 130, 132, or 134. In the illustrated embodiment, for example, sheet pans 106 are received between rack 130 and rack 132 in a generally widthwise orientation, and sheet pans 108 are received between rack 132 and rack 134 in a generally lengthwise orientation. Racks 130 and 132 are thus connected to the mounting fixtures 126 and 128 such that a spacing between the racks 130 and 132 closely matches a width dimension of sheet pans 106. For example, the width dimensions of the sheet pans 106 may be sized up and then used to determine proper placement of the racks 130 and 132 to accommodate the sheet pans 106 therebetween. And rack 134 is connected to the mounting fixtures 126 and 128 such that a spacing between racks 132 and 134 closely matches a length dimension of the sheet pans 108. For example, the length dimensions of the sheet pans 108 may be sized up and then used to determine proper placement of the rack 134 relative to rack 132 to accommodate the sheet pans 108 therebetween. Sheet pans 106 can be slid between support sections 144 of racks 130 and 132 with one side of each sheet pan 106 received between adjacent support sections 144 of rack 130, and an opposite side of each sheet pan 106 received between corresponding adjacent support sections 144 of rack 132. And sheet pans 108 can be slid between support sections 144 of racks 132 and 134 with one side of each sheet pan 108 received between adjacent support sections 144 of rack 132 (together with one side of each sheet pan 106), and an opposite side of each sheet pan 108 received between corresponding adjacent support sections 144 of rack 134.

The connection members 152 and 154 extending through the support sections 144 of each rack 130, 132, and 134 generally divide each support section 144 widthwise in half such that each of the racks 130, 132, and 134 can receive sides of two different sheet pans 106 and 108 into the racks 130, 132, and 134 on opposite sides of the connection members 152 and 154. The sides of the sheet pans 106 and 108 received between the adjacent support sections 144 of each rack 130, 132, and 134 may abut against the connection members 152 and 154 within the racks 130, 132, and 134. This may help stop the sheet pans 106 and 108 from extending laterally through the each rack 130, 132, and 134 between the support sections 144 (e.g., when they are placed in the racks 130, 132, and 134, during washing operation, etc.). Thus, connection members 152 and 154 may, for example, be viewed as stops of the rack system 102.

Once the sheet pans 106 and 108 to be cleaned are placed in the rack system 100, the washing assembly 102 may be operated to clean the sheet pans 106 and 108. The washing assembly tank 104 may be filled to an operating level with cleaning fluid, and the one or more pumps can be operated to pump the fluid from tank 104 through the inlet 110 to the outlets 112. The sheet pans 106 and 108 and the rack system 100 can be generally oriented within the tank 104 so that fluid from the outlets 112 is dispersed into the tank 104 in a direction that allows the fluid to move generally between the sheet pans 106 and 108 (e.g. the support sections 144 of each of the racks 130, 132, and 134 holding the sheet pans 106 and 108 can be generally aligned generally transverse to the fluid being dispersed into the tank 104). This orientation may substantially improve cleaning operation because the moving fluid can pass between the sheet pans 106 and 108. In addition, the sheet pans 106 and 108 may be at an angle in the rack system 100 so that the operating level of the cleaning fluid substantially covers the sheet pans 106 and 108. When washing operation is finished, the sheet pans 106 and 108 may be removed, and the rack system 102 may be adjusted, for example, to accommodate different kitchenware for subsequent washing operations.

In the illustrated embodiment, the hanging basket 135 may be connected to the washing assembly tank 104 via the second mounting fixture 128 of the rack system 100. The hanging basket 135 may include one or more hooks configured (e.g., sized, shaped, constructed, etc.) to be received into the openings 141 of the second mounting fixture 128 to connect the hanging basket 135 to the tank 104. The hanging basket 135 may be located as desired within the tank 104 by positioning the one or more hooks of the hanging basket 135 in one or more of the plurality of openings 141 of the second mounting fixture 128. The hanging basket 135 may also be adjusted within the tank 104. For example, the hanging basket 135 may be disconnected from the second mounting fixture 128 by removing the one or more hooks from the openings 141 of the second mounting fixture 128. The hanging basket 135 may then be adjusted as desired, and subsequently reconnected to the tank 104 at the second mounting fixture 128 in the adjusted position. In the illustrated embodiment, the hanging basket 135 is disclosed as connectable to the second, rearward mounting fixture 128. In other exemplary embodiments, hanging baskets may be connectable to a first, forward mounting fixture, or hanging baskets may be connectable to both a first, forward mounting fixture and a second, rearward mounting fixture.

In other exemplary embodiments, rack systems may include racks that are integral with walls of washing assembly tanks. For example, at least one of the walls of a washing assembly tank may be configured (e.g., sized, shaped, constructed) to receive at least part of kitchenware to be washed in the tank. In one exemplary embodiment, a first rack of a rack system includes multiple aligned and generally parallel slots, grooves, etc. formed in a wall of a washing assembly tank. The slots, grooves, etc. are spaced apart and can define, for example, a gap sized to receive, for example, a side edge of a sheet pan into the rack. And a second rack of the rack system is spaced apart from the first rack to receive an opposite side edge of the sheet pan. The sheet pan can be held between the racks for washing in the tank.

In further exemplary embodiments, rack systems may include racks with grooves, channels, etc. formed therein to receive kitchenware in the grooves, channels, etc. to hold the kitchenware in the racks. In one exemplary embodiment, for example, a frame of a rack may be formed as a single piece of material (e.g., by a mold process, etc.) with grooves, channels, etc. formed therein. Here, the grooves, channels, etc. may be configured (e.g., sized, shaped, constructed, etc.) to hold kitchenware in the rack within a washing assembly tank. In another exemplary embodiment, a frame of a rack may be formed from two or more pieces of material with grooves, channels, etc. formed in at least one of the pieces of material and/or with grooves, channels, etc. formed by assembly of the two or more pieces of material together. The grooves, channels, etc. may be configured (e.g., sized, shaped, constructed, etc.) to hold kitchenware in the rack.

In other exemplary embodiments, rack systems may include racks that are adjustable within a tank of a washing assembly differently than for the rack assembly 100 previously described and illustrated in FIGS. 1-10. In addition, hanging baskets may be adjustable within a tank of a washing assembly differently than described and illustrated herein. Further, hanging baskets may be adjustable within a washing assembly tank by operation similar to that disclosed for racks. In one exemplary embodiment, a mounting fixture of the rack system includes a channel configured (e.g., sized, shaped, constructed, etc.) to receive a portion (e.g., a roller, a bearing, a slide, etc.) of a mount of a rack. Here, the mount is configured to slide, roll, glide, etc. along the channel as desired to adjust the rack within a washing assembly tank. The mounting fixture and/or rack mount may also include a lock to help hold the rack in the desired location, for example, during placement of kitchenware into the rack system, during washing operation of the kitchenware, during removing of the kitchenware from the rack system, etc. In another exemplary embodiment, a mount of a rack may be configured (sized, shaped, constructed, etc.) to ride and/or slide along a rail of a mounting fixture to adjust the rack within a washing assembly tank. For example, the rack mount may include a guide that can couple to the mounting fixture rail and ride and/or slide along the rail when desired to adjust the rack within the tank. In a further exemplary embodiment, a mounting fixture may include a slide bar, and a rack may include a guide that can couple to the slide bar and slide along the bar within the tank. The slide bar may include notches configured (e.g., sized, shaped, constructed) to receive the guide and hold the rack in a desired position within the tank. The rack may be adjusted by releasing the guide from the notch (e.g., moving the guide out of the notch), moving the rack to the desired adjusted position, and positioning the guide in the corresponding slide-bar notch. In still another exemplary embodiment, a mounting fixture may include a tension clip that connects to (e.g., squeezes, etc.) a rail of a mounting fixture to connect the rack to the mounting fixture. Here, the clip may be released from the rail when desired to adjust the rack, and subsequently be reconnected to the rail at the desired adjusted location. In still other exemplary embodiments, clamps (e.g., spring clamps, etc.) may be used to connect racks to tanks.

In still other exemplary embodiments, rack systems may include racks connectable directly to walls of a washing assembly tank. For example, in one exemplary embodiment a washing assembly tank may include forward and rearward walls with openings formed therein. Mounting pins of at least one of the racks may be configured (e.g., sized, shaped, constructed, etc.) to be positioned within the openings in the walls of the tanks to connect the at least one rack to the tank. Openings may include, but should not be limited to, holes, notches, etc.

In still further exemplary embodiments, rack systems may include racks in which portions of the racks are adjustable relative to other portions of the racks. For example, in one exemplary embodiment, a rack system includes a rack having a frame, a forward mount, and a rearward mount. Here, the frame is connected to the mounts such that the frame may be adjusted within the tank relative to the forward and/or rearward mount.

The materials, dimensions, angular orientations, etc. provided herein are for purposes of illustration only, as a rack system may be formed from different materials and/or with different dimensions and/or with different angular orientations depending, for example, on the particular application, such as the size of the washing assembly tank, the kitchenware to be washed, and other factors.

Aspects of the present disclosure should not be limited to washing any particular type of items as various embodiments of the present disclosure may provide washers that are capable of washing a variety of kitchenware, dishware, food service ware and equipment, pots, pans, food trays, grease filters, gratings, tableware, among other items. Indeed, embodiments of the present disclosure can also be used for meat thawing and for washing produce, fruits, vegetables, seafood, oysters, clamshells, crustaceans, non-kitchen items, non-food items, metal parts, plastic parts, etc. As another example, a rack system and washing assembly of the present disclosure could be used for washing plastic or metal parts in a manufacturing or industrial application.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

It will be understood that, although the terms first, second, third etc. may be used herein to describe various elements, components, regions, portions, and/or sections, these elements, components, regions, portions, and/or sections should not be limited by these terms. These terms are only used to distinguish one element, component, region, portion, or section from another element, component, region, portion, or section. Thus, a first element, component, region, portion, or section discussed below could be termed a second element, component, region, portion, or section without departing from the scope of the example embodiments.

Certain terminology is used herein for purposes of reference only, and thus is not intended to be limiting. For example, terms such as "upper", "lower", "above", and "below" refer to directions in the drawings to which reference is made. Terms such as "front", "forward", "back", "rear", "rearward", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order or quantity unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted.

The present disclosure is merely exemplary in nature and, thus, variations that do not depart from the gist of the present disclosure are intended to be within the scope of the present disclosure. Such variations are not to be regarded as a departure from the spirit and scope of the present disclosure.

What is claimed is:

1. A rack system suitable for installation to a kitchenware washing assembly, the kitchenware washing assembly having a tank for holding fluid for washing kitchenware, and walls defining the tank and being arranged to hold the fluid in the tank, the rack system comprising:

a first mounting fixture connectable to the tank of the kitchenware washing assembly in a substantially horizontal orientation with a substantially fixed position relative to the tank;

a second mounting fixture connectable to the tank of the kitchenware washing assembly in a substantially horizontal orientation with a substantially fixed position relative to the tank;

at least one rack configured to be coupled to the first and second mounting fixtures for holding the kitchenware in the tank, the at least one rack comprising:

a first mount configured to be coupled to the first mounting fixture;

a second mount configured to be coupled to the second mounting fixture; and a frame disposed between the first mount and the second mount, the frame including:

a first support defined by an upper side, a lower side, and opposing longitudinal sides all contained within a plane; and a second support defined by an upper side, a lower side, and opposing longitudinal sides all contained within a plane, the second support oriented substantially parallel to and spaced apart from the first support, the first and second supports defining a slot therebetween for receiving at least part of a piece of kitchenware into the slot between the first and second supports;

wherein when the at least one rack is coupled to the first and second mounting fixtures, the planes containing the sides of the first and second supports are each oriented relative to a horizontal plane at an angle that is less than ninety degrees and greater than forty-five degrees;

wherein the at least one rack is moveable between a plurality of positions relative to the first and second mounting fixtures generally horizontally along the first and second mounting fixtures, such that the at least one rack can accommodate different sizes and/or shapes of kitchenware from one washing cycle to another washing cycle;

wherein the at least one rack includes two racks each having at least two pins; and wherein the first and second mounting fixtures each includes at least one through hole, a first pin of each rack configured to be releasably inserted into a through hole in the first mounting fixture and a second pin of each rack configured to be releasably inserted into a through hole in the second mounting fixture to releasably couple each rack to the respective first and second mounting fixtures in spaced apart relation for holding the kitchenware in the tank generally between the two racks, such that the racks can be disengaged from the first and second mounting fixtures and reengaged with the first and second mounting fixtures in different positions.

2. The rack system of claim 1 wherein the frame of the at least one rack further comprises:

a stop extending between the first and second supports, the stop configured to inhibit the piece of kitchenware from passing through the slot defined between the first and second supports in a direction generally parallel to the planes containing the sides of the first and second supports;

three or more supports including the first and second supports; and at least one connection member coupled to at least one side of each of the supports to hold the supports substantially parallel to each other and spaced apart from each other; and wherein at least one of the two racks is moveable between the plurality of positions relative to the first and second mounting fixtures generally horizontally along the first and second mounting fixtures to accommodate the different sizes and shapes of kitchenware between the two racks.

3. The rack system of claim 1 wherein the at least one rack is slidable generally horizontally along the first and second mounting fixtures between the plurality of positions.

4. A method for installing a rack system to a kitchenware washing assembly to hold kitchenware in a tank of the kitchenware washing assembly, the tank including at least two walls arranged to hold the fluid in the tank, the method comprising:

connecting a first mounting fixture to a first wall of the at least two walls of the tank of the kitchenware washing assembly, the first mounting fixture connected in a substantially horizontal orientation along the first wall in a substantially fixed position relative to the first wall;

connecting a second mounting fixture to a second wall of the at least two walls of the tank of the kitchenware washing assembly, the second mounting fixture connected in a substantially horizontal orientation along the second wall in a substantially fixed position relative to the second wall;

releasably coupling a first rack to one of a plurality of locations horizontally along the first and second mounting fixtures such that supports of the first rack are oriented relative to a bottom wall of the tank at an angle that is less than ninety degrees and greater than forty-five degrees;

releasably coupling a second rack to one of a plurality of locations horizontally along the first and second mounting fixtures such that the second rack is spaced apart from the first rack, and such that supports of the second rack are oriented relative to the bottom wall of the tank at an angle that is less than ninety degrees and greater than forty-five degrees, and such that the second rack is moveable between a plurality of positions generally horizontally along the first and second mounting fixtures within the tank relative to the first rack to accommodate different sizes and/or shapes of kitchenware in the tank between the first and second racks from one washing cycle to another washing cycle;

wherein the first rack is configured to receive at least part of a piece of kitchenware in the first rack and the second rack is configured to receive at least part of the same piece of kitchenware in the second rack;

wherein releasably coupling the first and second racks to the first mounting fixture includes inserting a pin of the first rack into a through hole of the first mounting fixture and inserting a pin of the second rack into a through hole of the first mounting fixture; and wherein releasably coupling the first and second racks to the second mounting fixture includes inserting a pin of the first rack into a through hole of the second mounting fixture and inserting a pin of the second rack into a through hole of the second mounting fixture, such that the first and second racks can be disengaged from the first and second mounting fixtures and reengaged with the first and second mounting fixtures in different positions.

5. The method of claim 4 wherein releasably coupling the first and second racks to one of a plurality of locations horizontally along the first and second mounting fixtures includes coupling the first and second racks to the first and second mounting fixtures so that the first and/or second rack is slidable generally horizontally along the first and second mounting fixtures between the plurality of positions within the tank.

6. The method of claim 4, further comprising aligning a gap defined between adjacent supports of the first rack with a gap defined between adjacent supports of the second rack so that the piece of kitchenware can be received in the aligned gaps.

7. A rack system for installation to a commercial, top-loading kitchenware washing assembly for accommodating different sizes and/or shapes of kitchenware in the washing assembly from one washing cycle to another washing cycle, the kitchenware washing assembly having a tank for holding fluid for washing kitchenware, the tank having a bottom wall, a first wall, a second wall spaced from the first wall and generally opposing the first wall, a third wall positioned generally transverse to the first and second walls, and a fourth wall spaced from the third wall and generally opposing the third wall, the rack system comprising:

a first mounting fixture connectable to the first wall and a second mounting fixture connectable to the second wall; and a first rack and a second rack each including:

a first mount configured to be coupled to the first wall of the tank;

a second mount configured to be coupled to the second wall of the tank; and a frame between the first mount and the second mount, the frame including:

a first support defined by an upper side, a lower side, and opposing longitudinal sides extending between the upper side and the lower side;

a second support defined by an upper side, a lower side, and opposing longitudinal sides extending between the upper side and the lower side, the second support oriented substantially parallel to and spaced apart from the first support, the first and second supports defining a slot therebetween for receiving at least part of a piece of kitchenware into the slot between the first and second supports; and a stop extending between the first and second supports to inhibit the piece of kitchenware from passing through said slot in a direction generally transverse to a direction between the first mount and the second mount;

wherein the first and second racks are configured to cooperatively support the piece of kitchenware in the tank between the first and second racks with at least part of the piece of kitchenware positioned within the slot between the first and second supports of the first rack and with at least part of the piece of kitchenware positioned within the slot between the first and second supports of the second rack, and wherein the stop of the first rack inhibits the piece of kitchenware from passing through the slot between the first and second supports of the first rack and the stop of the second rack inhibits the piece of kitchenware from passing through the slot between the first and second supports of the second rack;

wherein the first and second racks are configured to be releasably coupled to the tank between, and substantially perpendicular to, the first and second walls of the tank;

wherein each of the first mount and the second mount of each of the first and second racks includes a mounting pin configured to fit within one of a plurality of through holes associated with the tank, such that the first and second racks can be disengaged from the tank and reengaged with the tank, via the through holes, in different positions;

wherein a size of kitchenware that can be supported between the first rack and the second rack is established by a distance between the first rack and the second rack, and wherein the first rack is moveable generally horizontally within the tank relative to the second rack between a plurality of positions between the third and fourth walls to vary said distance so that different sizes and/or shapes of kitchenware can be positioned within the tank between the first and second racks from one washing cycle to another washing cycle; and wherein each of the first and second mounting fixtures includes a plurality of the through holes configured to receive the mounting pins.

* * * * *